US011168528B2

(12) United States Patent
McGuire et al.

(10) Patent No.: US 11,168,528 B2
(45) Date of Patent: Nov. 9, 2021

(54) UNIVERSAL ATMOSPHERIC DEPLOYMENT DEVICE

(71) Applicant: OIL STATES ENERGY SERVICES, L.L.C., Houston, TX (US)

(72) Inventors: Bob McGuire, Meridian, OK (US); Danny L Artherholt, Asher, OK (US); Mickey Claxton, Oklahoma City, OK (US); Blake Mullins, Edmond, OK (US); Darin Grassmann, Piedmont, OK (US); Jimmy Livingston, Manvel, TX (US)

(73) Assignee: OIL STATES ENERGY SERVICES, L.L.C., Houston, TX (US)

( * ) Notice: Subject to any disclaimer, the term of this patent is extended or adjusted under 35 U.S.C. 154(b) by 5 days.

(21) Appl. No.: 16/799,478

(22) Filed: Feb. 24, 2020

(65) Prior Publication Data

US 2020/0277832 A1 Sep. 3, 2020

Related U.S. Application Data

(60) Provisional application No. 62/811,946, filed on Feb. 28, 2019.

(51) Int. Cl.
*E21B 23/10* (2006.01)
*E21B 34/06* (2006.01)

(52) U.S. Cl.
CPC ..... *E21B 23/10* (2013.01); *E21B 34/06* (2013.01)

(58) Field of Classification Search
CPC ..... E21B 23/00; E21B 23/001; E21B 23/08; E21B 23/10; E21B 34/06
See application file for complete search history.

(56) References Cited

U.S. PATENT DOCUMENTS 5,188,178 A * 2/1993 Noyes ..... E21B 33/068 166/310
6,457,526 B1 * 10/2002 Dailey ..... E21B 7/124 166/338
6,488,093 B2 * 12/2002 Moss ..... E21B 19/22 166/339
8,006,765 B2 * 8/2011 Richards ..... E21B 17/023 166/351
2012/0090828 A1 * 4/2012 Webre ..... E21B 17/026 166/77.53

* cited by examiner

*Primary Examiner* — Brad Harcourt
(74) *Attorney, Agent, or Firm* — Morgan, Lewis & Bockius LLP

(57) ABSTRACT

A universal atmospheric deployment device ("UADD") for use in oil and gas production or similar applications is provided. In one embodiment, the UADD includes a number of storage carriers disposed around a pathway that can be deployed into a well bore. The figures and art described herein show that this novel feature can increase the speed and usefulness of dispatching tools down a well bore, and also decrease down time to install or retrieve these devices. This UADD also removes personnel from the hazardous area, allowing for remote deployment of tools and devices.

22 Claims, 17 Drawing Sheets

UNIVERSAL ATMOSPHERIC DEPLOYMENT DEVICE

FIELD OF THE INVENTION

The invention relates to a universal atmospheric deployment device ("UADD") mounted atop a pressure-to-atmosphere control apparatus. The UADD allows for access to a number of different tools and devices stored in carriers arranged around a drop zone which is axially aligned with a wellbore. The tools and devices may be selected by indexing the carriers and using a shared deployment device to select the proper tool or device, or by use of carrier-specific deployment devices that are activated to deploy the selected tool or device. Although the UADD is primarily described in reference to carriers with home positions located within a circular pathway moving relative to a home position, the home position can be in any arrangement that would allow an operator to select a tool or device, move the tool or device out of the home position to align with the drop zone, and drop the tool or device into the wellbore. Because the tools or devices can be maintained in carriers that can be offset from the drop zone, the operator may retain access to the wellbore even when the UADD is installed. The UADD can also employ a non-circular, indexable pathway with a drop zone located within the pathway.

BACKGROUND OF THE INVENTION

Devices to drop tools into a wellbore are typically installed in what is referred to as the Christmas tree of a well. The Christmas tree is a series of valves at the surface of a well that allow for tools and devices to enter the well bore of a well from the surface. The Christmas tree is comprised of an arrangement of valves and blocks that can allow these tools and devices in as well as out of a well bore. The different types of valves found in a Christmas tree are often used in connection with the production of hydrocarbons such as crude oil or natural gas.

The UADD is a device that is connectable to the existing Christmas tree of a well bore to allow for various types of tools and devices to be deployed into the well bore through the deployment of a pressure-to-atmosphere control apparatus.

The UADD requires a valving arrangement to create a pressure barrier and sealing interface so that the UADD will not be exposed to well pressure. Thus, when the UADD is installed, it will remain at atmospheric pressures, even when tools are deployed down hole. In many applications, such as the production of hydrocarbons, interior pressures can be extremely high, on the order of 15,000 pounds per square inch. Any number of valves can be used to create a pressure barrier and sealing interface to the pressure of the well bore fluid as would be known in the art.

Among other objectives, the present invention addresses the need for a device that can be remotely operated in hazardous environments.

SUMMARY OF THE INVENTION

An aspect of the present invention is to provide an unmanned mechanism to deploy a number of different tools into a well bore through the use of carriers that house the tools or devices to be deployed. There are any number of possibilities because this device may be constructed with different carrier heights and sizes, travel pathways, or other options that can be easily manipulated. Thus, a ball, collet, dart, plug, or many additional tools or devices may be deployed from the pathway of the UADD. Carriers are not limited to cylindrical in design. The following disclosures are not limiting in the different devices that may be deployed from the UADD.

Another aspect of this invention is to allow for the selectability of tools to be deployed from the home position. The home positions may be indexable along a pre-determined pathway or be stationary. In many existing ball launchers, balls or plugs are loaded in a particular order and may only be released in that same order, but operators may find it desirable in certain circumstances to change the order or to drop a different type of device altogether. Because the UADD has individual tool or device carriers which can be offset from the drop zone, the tools can be selected at any time from their home position and deployed as selected. The carriers' home positions may be indexed until the intended tool or device is ready to be moved by a deployment device shared by all the carriers or carrier-specific deployment devices can be individually activated to move the tools or devices when requested.

Another aspect of the present invention is the integration of an atmospheric housing, instead of a pressurized housing. This atmospheric housing eliminates the maintenance required due to corrosive fluids or particulates which can cause seizing of the mechanical parts or even failure of the housing. Further, the atmospheric design may be designed as a lighter alternative and can therefore house and adjust to different tools or devices. Further, the atmospheric housing allows for additional loading of tools while a job is running in real time. Instead of interrupting the downhole activity to reload the UADD with additional tools or devices, they can be loaded in real time because the housings are at atmospheric pressures and no pressurized fluid is contained by the UADD. In fact, because the UADD is operated at atmospheric pressure, no outer housing is required at all.

Another aspect of the present invention is the option to provide carrier gates below each carrier. This eliminates potential rubbing of the tools on the housing and may act as a secondary precaution to ensure the tool is not dropped until the operator gives a remote command. Previous designs attempt to use the housing to directly support the tools when stationed in the home positions which increases the energy required to move the tools and can damage the tools before they are ever dropped into the well bore. Further, the optional carrier gates allow the tool or device carrier to be opened by a separate actuator, based on a remote command by an operator. This ensures that there can be no accidental dropping of a tool or device into the well bore and ensures that the UADD provides the selectivity discussed herein. If carrier-specific deployment devices are used, the carrier gates will additionally provide a method for securing the carrier and tool or device while it is being placed into alignment with the well bore prior to deployment.

Because the tools or devices are maintained in carriers with home positions that may be offset from the drop zone, the invention may comprise a deployment device to move the carriers into alignment with the drop zone. The deployment device allows for the carriers to be stored in such a position, i.e. positions away from the piping that connects to the well bore, to allow unobstructed access to the wellbore. The deployment device can be used to select any particular carrier and move it into position over the drop zone for deployment. Further, the deployment device may be integrated externally or internally to the UADD. The deployment device may be used to articulate many different types and designs of carriers, because it is not limited to a specific mechanism by which it will attach itself to the carriers. A number of different mechanical linkages, including but not limited to, collars, compression grips, sleeves, and actuated devices may be used to attach the deployment device to the carrier.

Another aspect of the present invention is to provide the ability to drop multiple different types of tools into the well bore from one UADD. Because the tool or device carrier can be designed with multiple heights, diameters, or configurations, different tools and devices may be dropped into the well bore based on the various design variables that can be manipulated in the UADD. Additionally, multiple UADDs can be stacked to create additional options for tool and device deployment.

In an exemplary embodiment, the UADD has carriers with home positions in a circular, indexable pathway with a drop zone offset from the pathway such that the drop zone axis is collinear with the pathway axis. In another embodiment, the UADD has carriers with home positions in a circular, indexable pathway with a drop zone offset from the pathway such that the drop zone axis is not collinear with the pathway axis. In another embodiment, the UADD has carriers with home positions in a non-circular pathway with a drop zone offset from the pathway. In another embodiment, the UADD has carriers with home positions in a non-circular pathway with a drop zone located within the pathway. In another embodiment, the UADD has carriers with stationary home positions with a drop zone offset from the home positions.

Any number of different mechanical devices may be used as a deployment device. This includes, but is not limited to, devices that are capable of radially translating each carrier in a linear manner, such that the carriers are moved in a straight line into alignment with the drop zone. For example, a scissor arm may be used, as explained in further detail below. Other similar deployment devices include simple devices such as spring loaded devices, single stage or multi-stage hydraulic cylinders, gear trains (for example, spur, helical, planetary, worm, and/or rack and pinion), pulley systems, track and roller systems, cams, or any combination thereof.

The UADD may use different types of drives to index the carriers as well, if an indexable configuration is desired. For example, one such drive could be a slewing drive or worm gear that indexes the carriers. These drives provide efficient transmission of high power and torque to the UADD. Another example could be an adjustable speed drive for increased speed of indexing to select tools or devices on the UADD. The drive can be AC, DC, or hydraulically driven. Other alternatives could include a number of different drive designs well known in the industry. Another example could be a ratcheting linear drive mechanism that could use linear actuators (hydraulic, pneumatic, or electric) to provide indexed movement. Another example could be a Geneva drive mechanism to provide motionless dwell periods between indexed movements.

The UADD may also have a retaining track for the carriers. This retaining track provides retention of the carriers in multiple directions. The retaining track thus ensures proper storage of the carriers in their home positions. The retaining track also ensures proper identification and selection of the tool or device that is intended to be selected. This also ensures the tools or devices are properly aligned for being moved to the drop zone and can be moved in place via the deployment method employed by the UADD.

Another optional feature of the UADD is a personnel platform and/or removable covers that may allow personnel access to the launching device when installed.

Another feature of the UADD is the option to deploy the UADD as a wired or wireless device. Deploying the UADD in a remote manner allows for operation in a hazardous environment away from personnel and out of the "red zone." The UADD may also have a remote shutdown, the ability to capture operational data, maintain operational redundancies, or be deployed manually by cable and hydraulic lines which support emergency response activities.

Another feature of the UADD is the option to insert a pressure tube over the drop zone that extends above the UADD. The pressure tube allows well pressure to pass through the UADD without exposing it to well pressure, thereby allowing wellbore access through the UADD but maintaining the UADD itself at atmospheric pressure. The pressure tube may be retained over the drop zone by methods including but not limited to hydraulically- and/or spring-activated dogs, threadable engagement of the pressure tube into the drop zone, or fasteners.

Another feature of the UADD is adjustable lifting components. The lifting components may be centrally, inwardly, or outwardly located and may be able to be repositioned or manipulated for different tool styles or different service requirements.

BRIEF DESCRIPTION OF THE DRAWINGS

Specific embodiments of the invention are described below with reference to the figures accompanying this application. The scope of the invention is not limited to the figures or embodiments described.

DETAILED DESCRIPTION OF THE INVENTION

Figure 1:
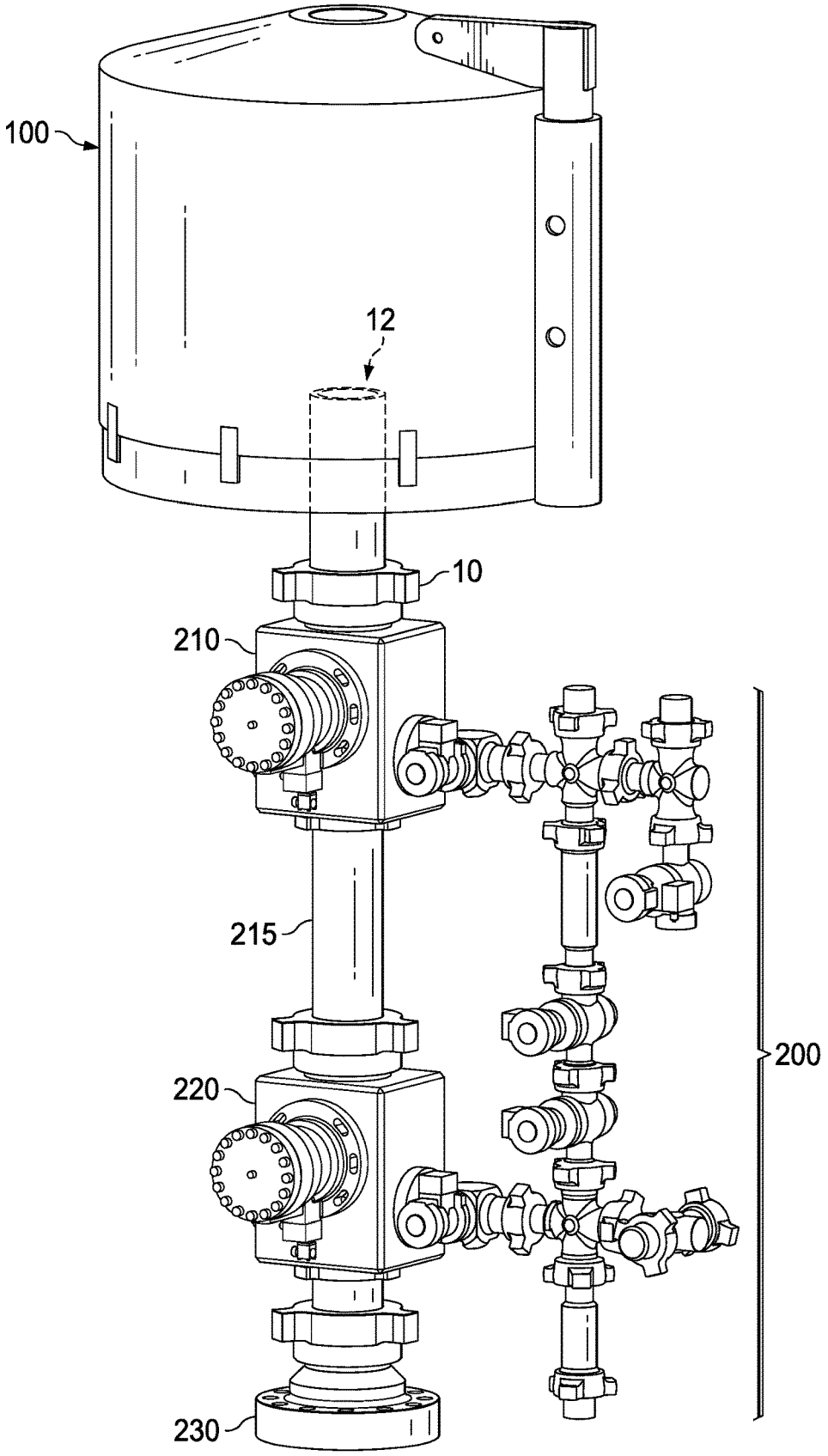
FIG. 1 depicts a view of one exemplary embodiment of the UADD when it is installed atop of a pressure-to-atmosphere control apparatus.

Referring to FIG. 1, the UADD 100 includes a connection to be installed on the pressure-to-atmosphere control apparatus 200 or similar apparatus. The upstream connection 10 allows for the tools or devices to enter the pressure-to-atmosphere control apparatus 200. The UADD drop zone 12 can be located in a region of the UADD that is offset from the home positions of the carriers. The pressure-to-atmosphere control apparatus 200 has an upstream isolation valve 210 and a downstream isolation valve 220 that isolate the UADD from system pressure downstream in the well bore. Substantially cylindrical tube 215 is located between upstream isolation valve 210 and downstream isolation valve, although the enclosed portion of UADD 100 between the valves may take any suitable configuration. These valves act as a pressure balancing system between the upstream isolation valve 210 and downstream isolation valve 220 to allow the tools or devices to enter the well bore, which is beyond flange 230, without the UADD being exposed to system pressure.

Figure 2:
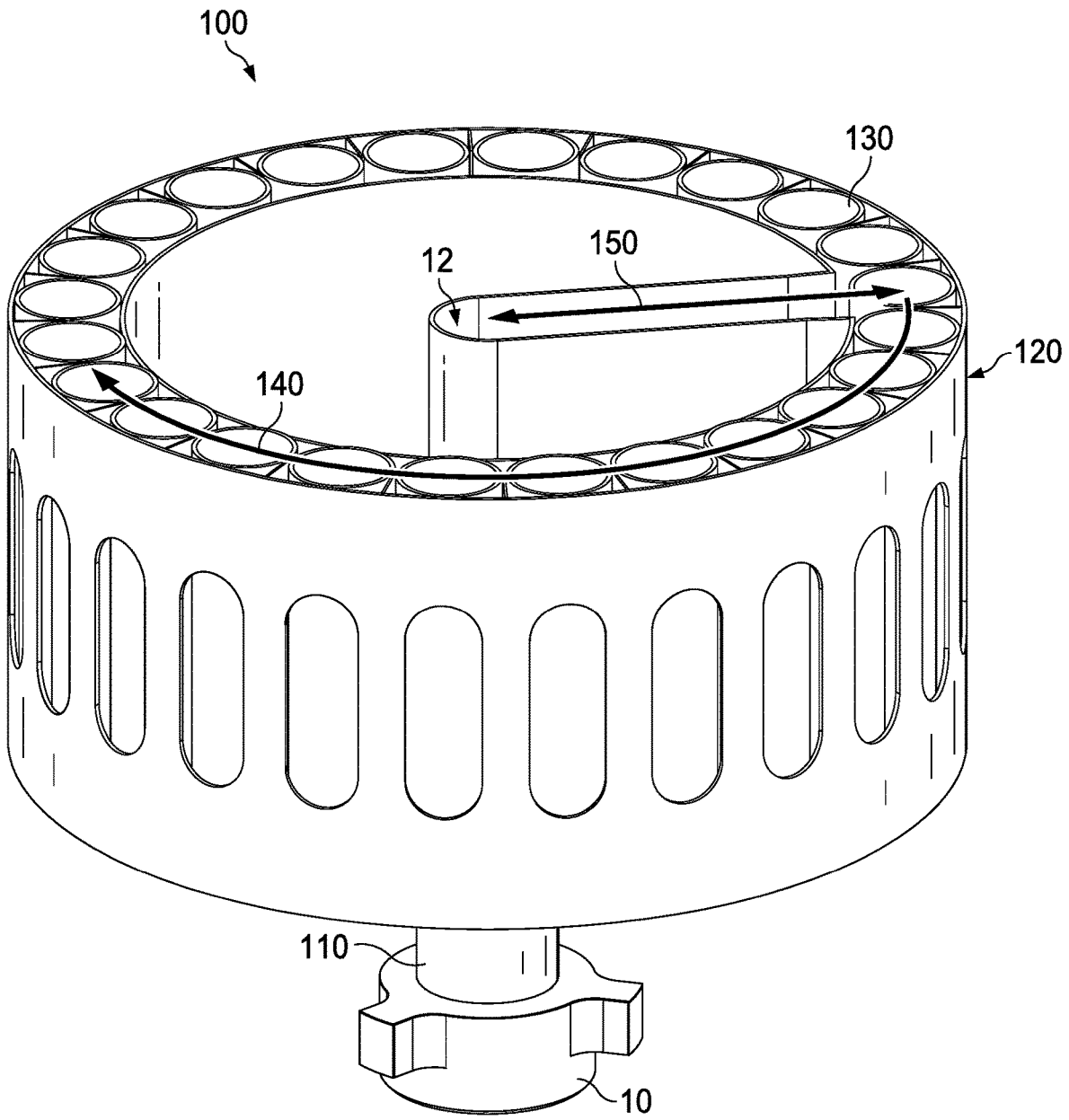
FIG. 2 depicts an internal view of an embodiment of a circular UADD with a centrally disposed drop zone.

Referring to FIG. 2, an exemplary embodiment of the UADD 100 is shown. The upstream wing connection 10 attaches to an internal tube 110 which extends to the interior of the UADD to form the drop zone 12 for tools and devices. The housing 120 consists of a number of carriers 130 that hold tools or devices. The carriers 130 can be of varying widths and heights, depending on the tool or device they hold. The carriers 130 move in a travel path 140 to align the selected carrier to the centrally disposed drop area 150. A deployment device may be used to move the carriers 130 to align with the drop zone 12. Each carrier may contain a selectable tool or device that can be deployed through internal tube 110 to the well bore.

Figure 3:
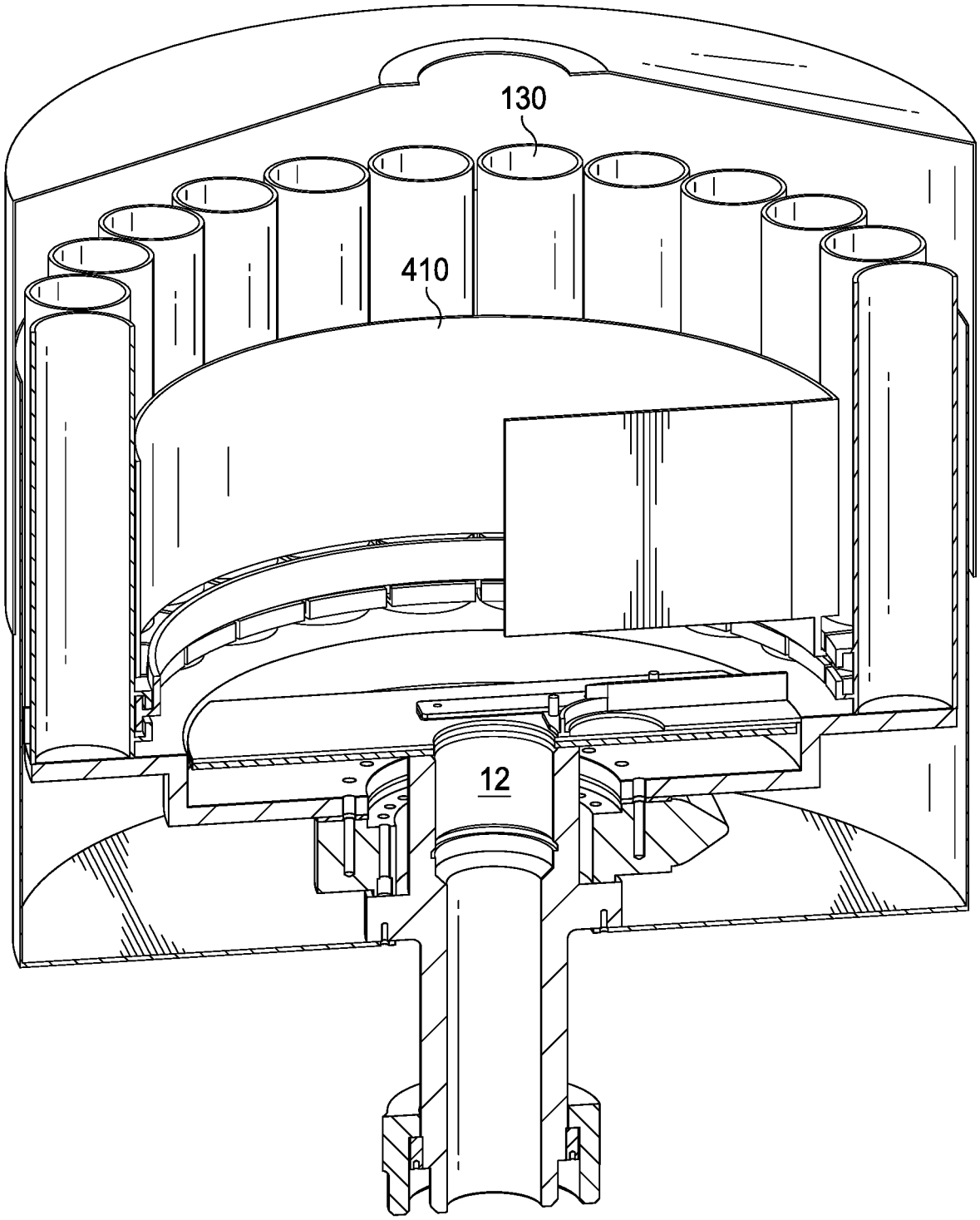
FIG. 3 depicts an internal view of the embodiment of FIG. 2 with a retaining track.

Referring to FIG. 3, the exemplary embodiment of FIG. 2 is shown with retaining track 410. Retaining track 410 ensures proper storage of the carriers 130 in their home positions until they are in the proper position to be moved into alignment with drop zone 12. Retaining track 410 also ensures proper identification and selection of the tool or device that is intended to be selected, and also that the tools or devices are properly aligned for being moved to the drop zone 12.

Figure 4:
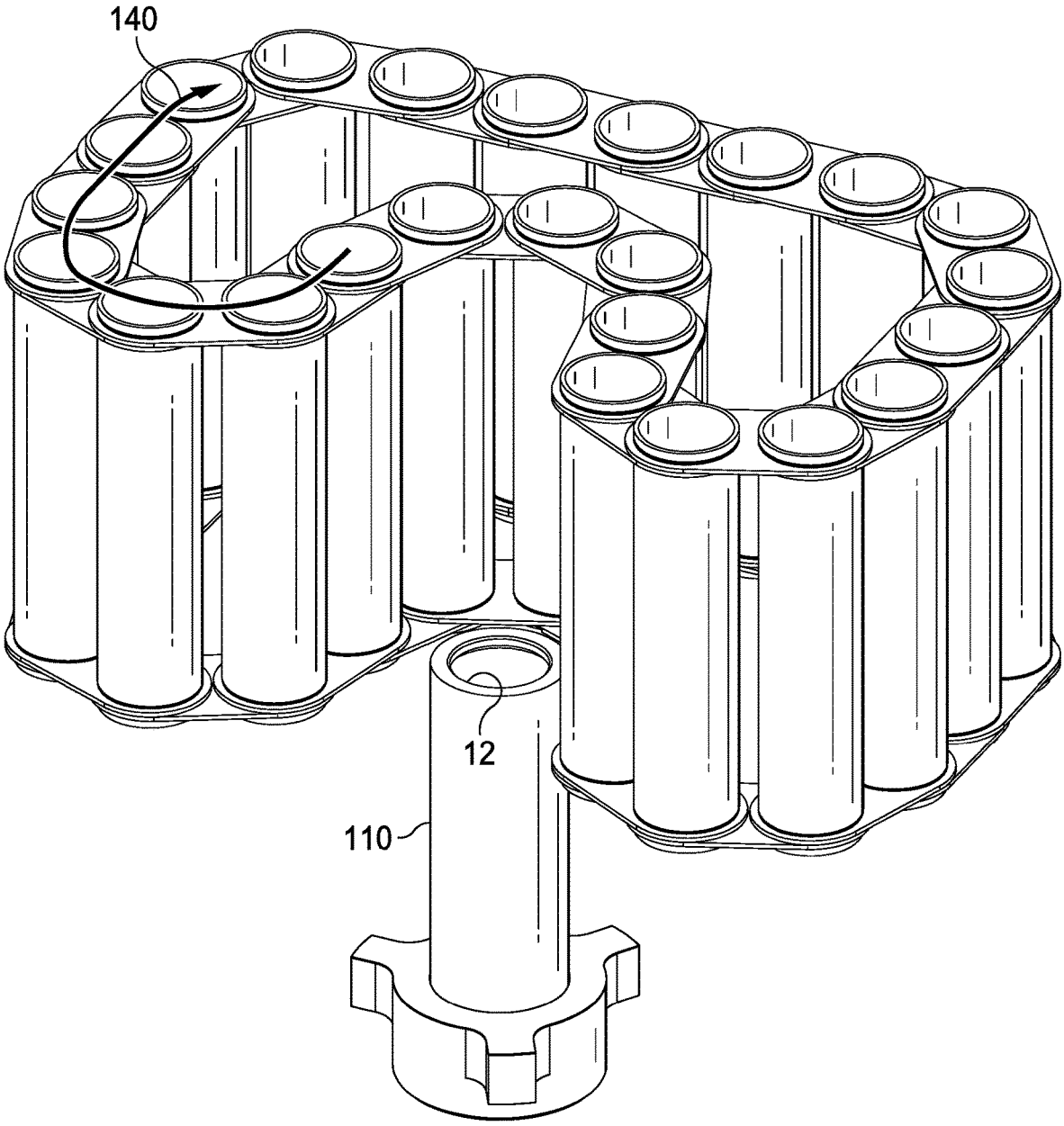
FIG. 4 depicts an embodiment of a non-circular UADD with a drop zone offset from the indexable pathway.
Figure 5:
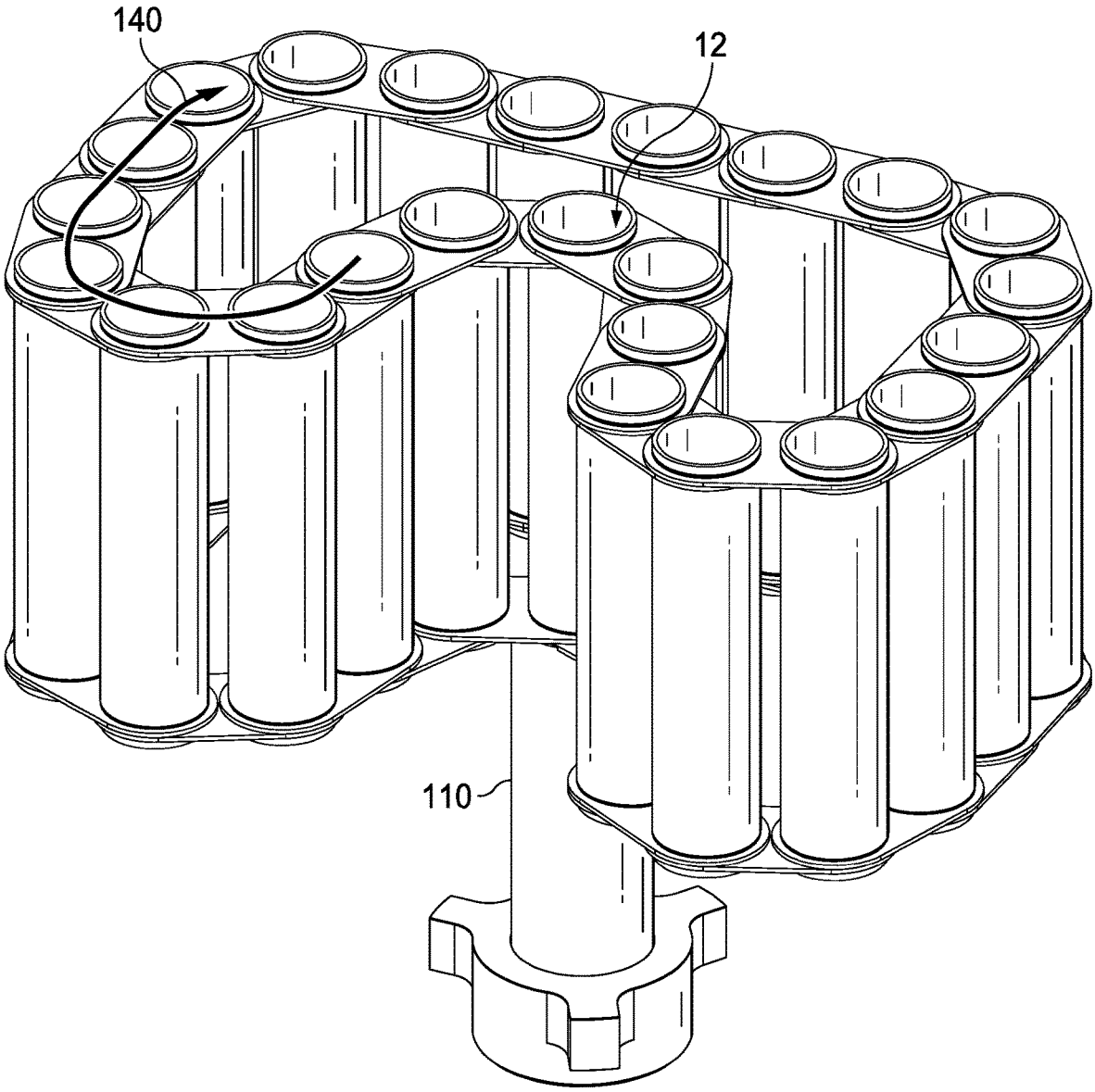
FIG. 5 depicts an embodiment of a non-circular UADD with a drop zone located within the indexable pathway.
Figure 6:
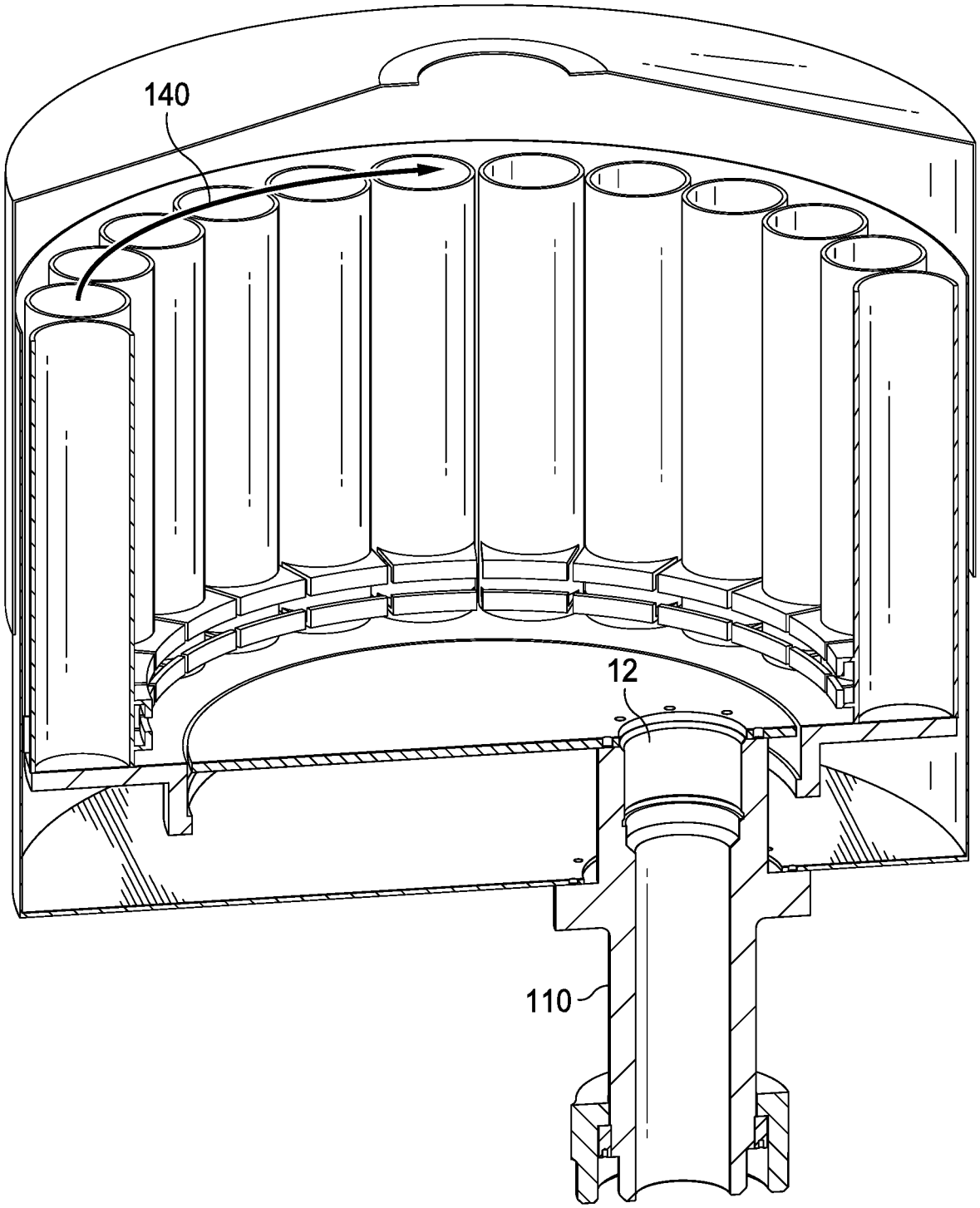
FIG. 6 depicts an embodiment of a circular UADD with a non-centrally disposed drop zone.
Figure 7:
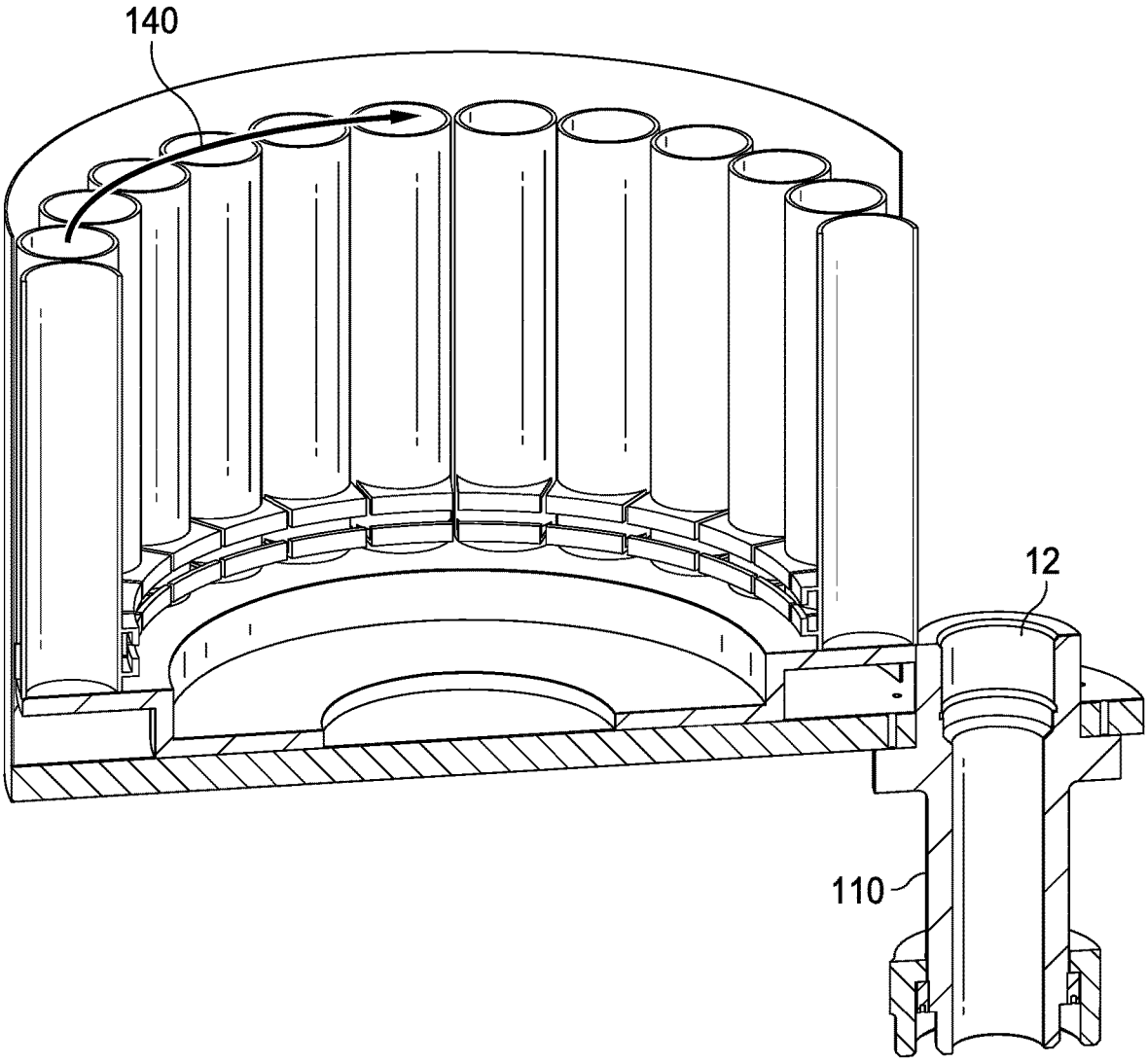
FIG. 7 depicts an embodiment of a circular UADD with a drop zone located radially outside of the circumference of the UADD.

Referring to FIG. 4-7, there are different indexable pathways that can be created for the carriers to travel. For example, FIGS. 4 and 5 show optional embodiments with a non-circular carrier pathway along a respective non-circular travel path 140. The internal tube 110 extends to the pathway where the carriers may be dropped through the drop zone 12. The drop zone 12 may be centrally or non-centrally disposed as in each respective figure. FIG. 6 shows a circular carrier pathway 140 but, unlike the embodiment of FIG. 2, drop zone 12 is located at a position that is axially offset from the central axis of the UADD. FIG. 7 also shows a circular pathway 140 but, unlike the embodiments of FIGS. 2 and 6, drop zone 12 is located at a position that is radially outside the circumference of the circular UADD.

Figure 8:
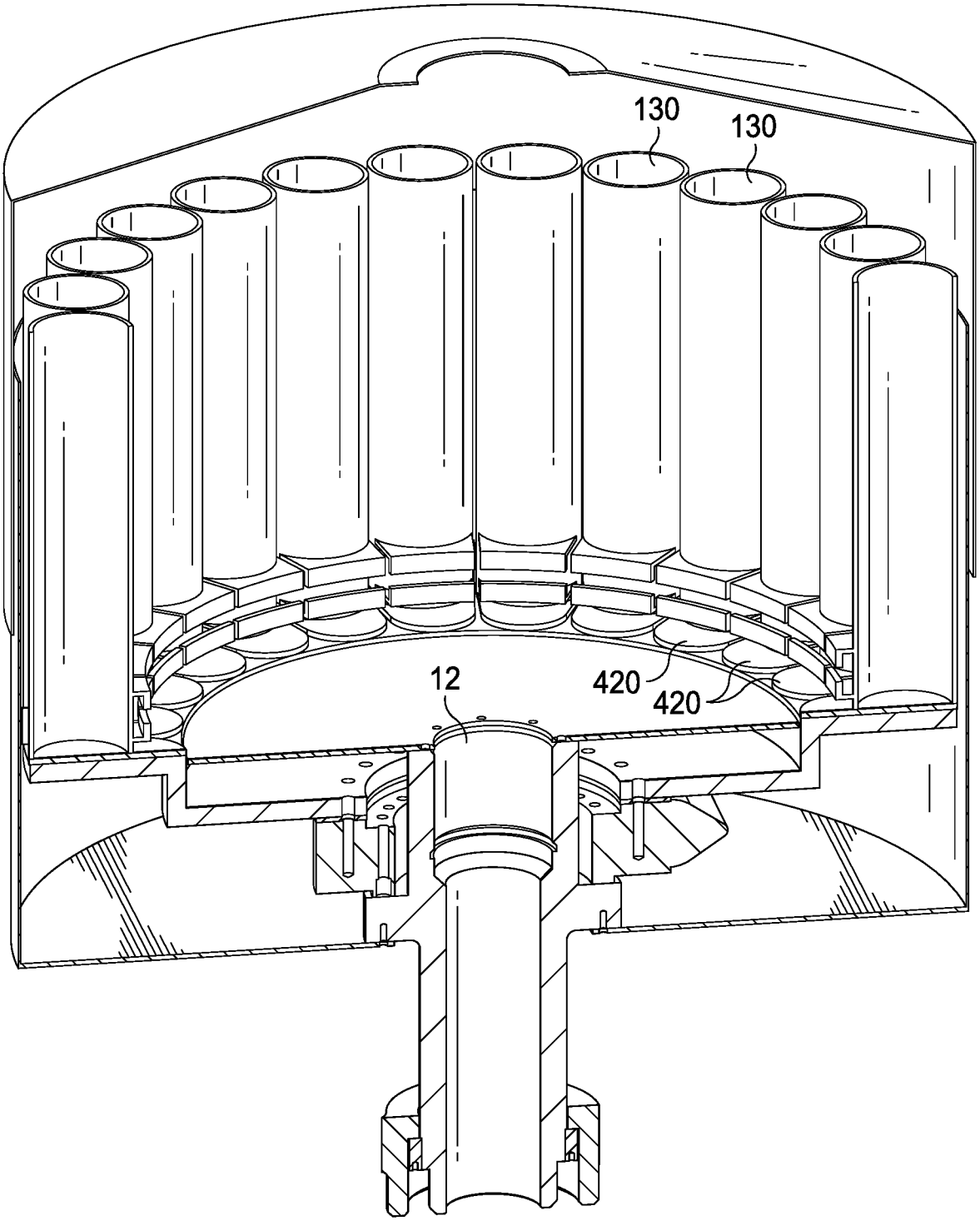
FIG. 8 depicts an internal view of the embodiment of FIG. 2 with individual carrier gates.

FIG. 8 depicts the embodiment of FIG. 2 with individual carrier gates 420 for each carrier 130. Carrier gate 420 will remain in place until carrier 130 is aligned with drop zone 12, at which time a separate actuator will cause the gate to open, thus allowing the tool to be released from carrier 130 into drop zone 12. This reduces the risk that a tool or device will be dropped inadvertently. Carrier gate 420 may also prevent the tool or device from contacting the bottom surface of the UADD, thus avoiding potential damage. If carrier-specific deployment devices are used, as discussed below with respect to FIGS. 15 and 16, carrier gates 420 will additionally provide a method for securing the tool or device within carrier 130 while it is being placed into alignment with the well bore prior to deployment.

Figure 9:
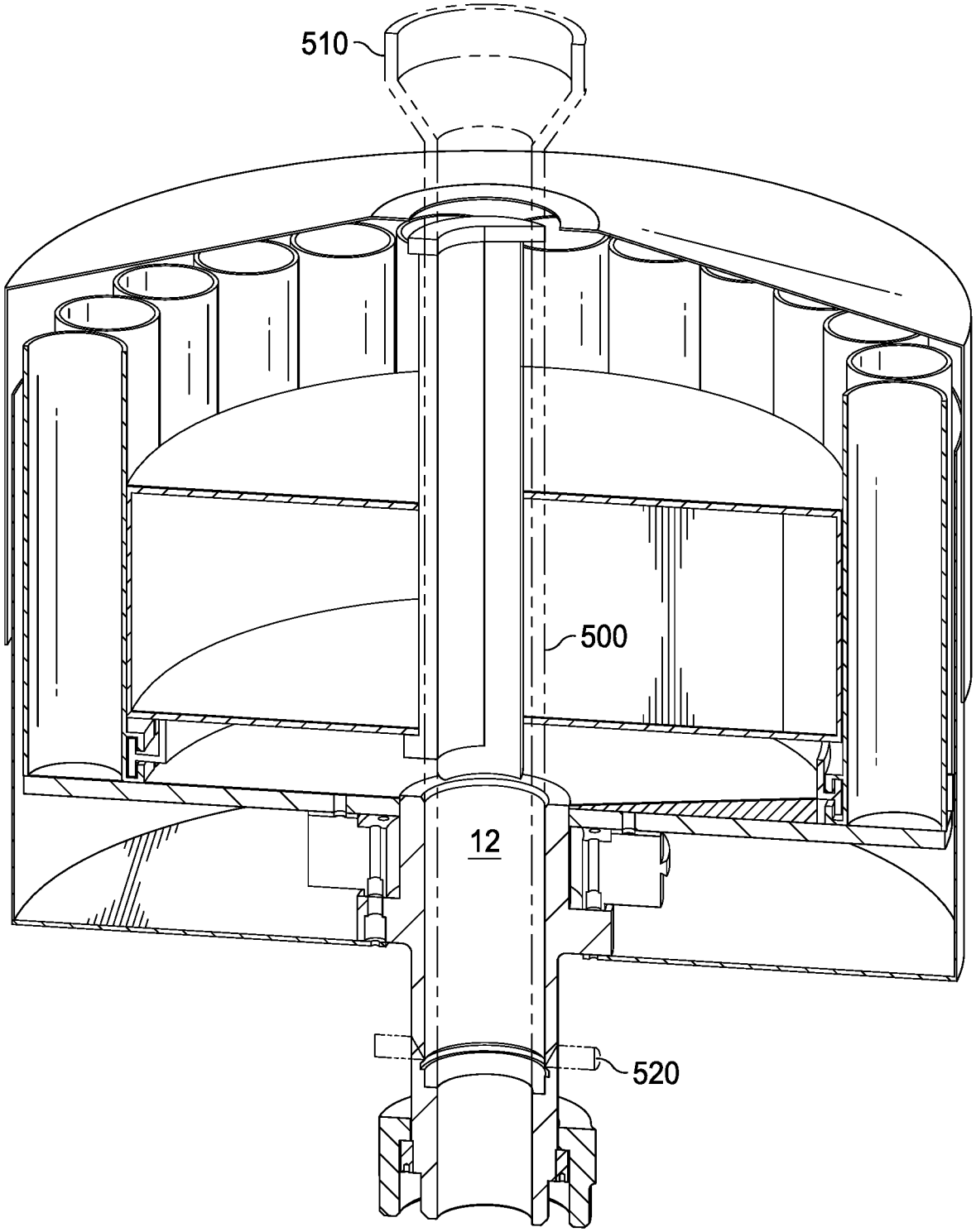
FIG. 9 depicts an embodiment that allows for well pressure to be contained through the UADD device itself through the use of a pressure tube.
Figure 10:
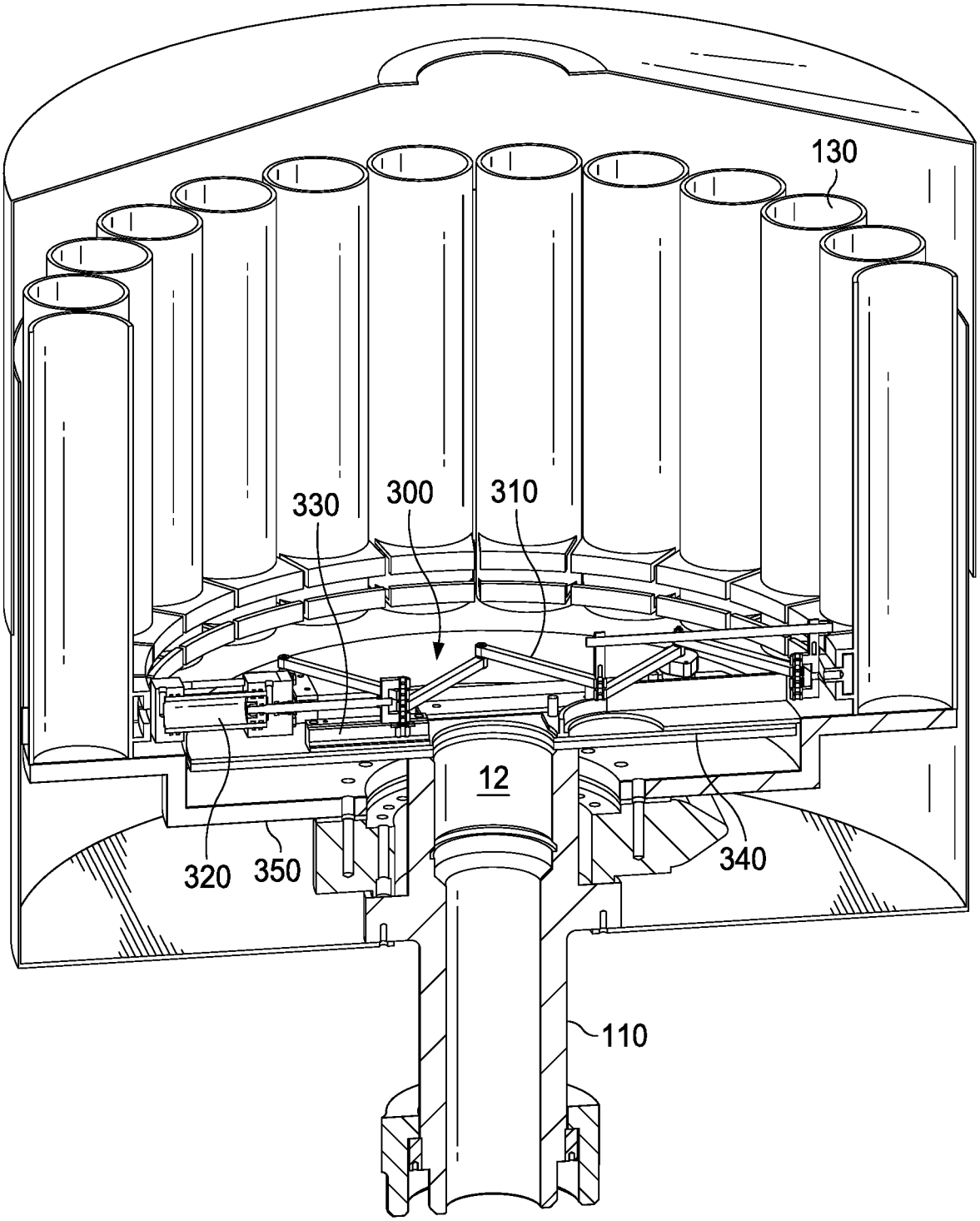
FIG. 10 depicts an exemplary embodiment of the UADD using internal scissor arms to grab the carrier and radially move it into alignment with the drop zone.

Referring to FIG. 9, the UADD may include a pressure tube 500 that is disposed in the central region of the UADD to withstand well pressures. This optional feature provides an important benefit, as it allows an operator access to the wellbore—for example, to run a wireline—without removing the UADD. The pressure tube 500 includes a top portion 510 which allows the tube to be connected to other devices above the UADD. The pressure tube may have dogs 520 to retain the pressure tube in place and allow for deconstruction if needed. Referring to FIG. 10, an internal view depicts an embodiment of the UADD interior. The UADD has the selectable carriers 130 surrounding a centrally disposed tube 110. The carriers are selectable by an operable scissor arm deployment device 300. The scissor arm 300 has an extendable arm 310 that can be extended by hydraulic actuator 320 and scissor guide 330 that guides the scissor arm deployment device. The trolley 340 supports the selectable carrier 130 over the drop zone 12 but allows the tool or device to be dropped. The scissor arm 300 can select the proper tool or device in its respective selectable carriers 130 by indexing the UADD. This figure also shows a slewing drive 350, that sits on top of the flange on the drop zone 12. Any other similar known gear drives, such as the ratcheting linear drive mechanism and Geneva drive mechanisms could also be employed.

Figure 11:
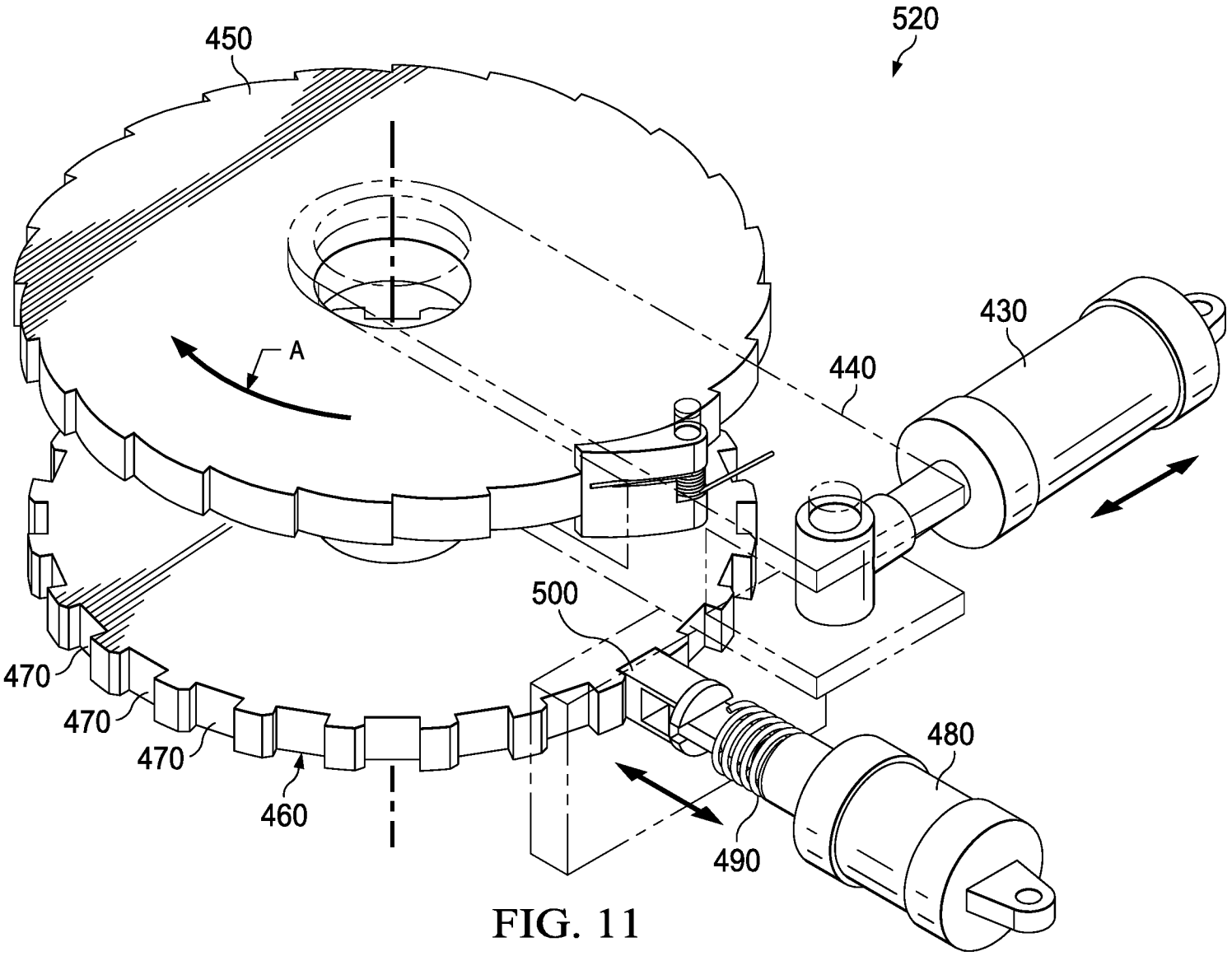
FIG. 11 depicts an exemplary embodiment of the UADD using a ratcheting linear drive mechanism.

FIG. 11 shows an example of a ratcheting linear drive mechanism 520 that could be used as an alternative to the slewing drive shown in FIG. 10. In this embodiment, hydraulic cylinder 430 is connected to torque arm 440, which is in turn connected to drive wheel 450. Drive wheel 450 is also connected to locking wheel 460. These components are configured such that the movement of hydraulic cylinder 430 exerts force on torque arm 440 in a direction that is tangential to drive wheel 450. The connection between torque arm 440 and drive wheel 450 causes drive wheel 450 to rotate in the direction indicated by arrow A in FIG. 11. The connection between drive wheel 450 and locking wheel 460 causes locking wheel 460 to rotate in cooperation with drive wheel 450. Locking wheel 460 comprises notches 470 which are spaced around the outer circumference. The ratcheting linear drive mechanism 520 also comprises locking pin 480, which includes a distal end 500 configured to mate with notches 470 on locking wheel 460. Locking pin 480 comprises a spring 490, which allows the distal end 500 to axially reciprocate such that it can withdraw from one notch 470 and then engage with the adjacent notch after locking wheel 460 has rotated following movement of hydraulic cylinder 430.

Figure 12:
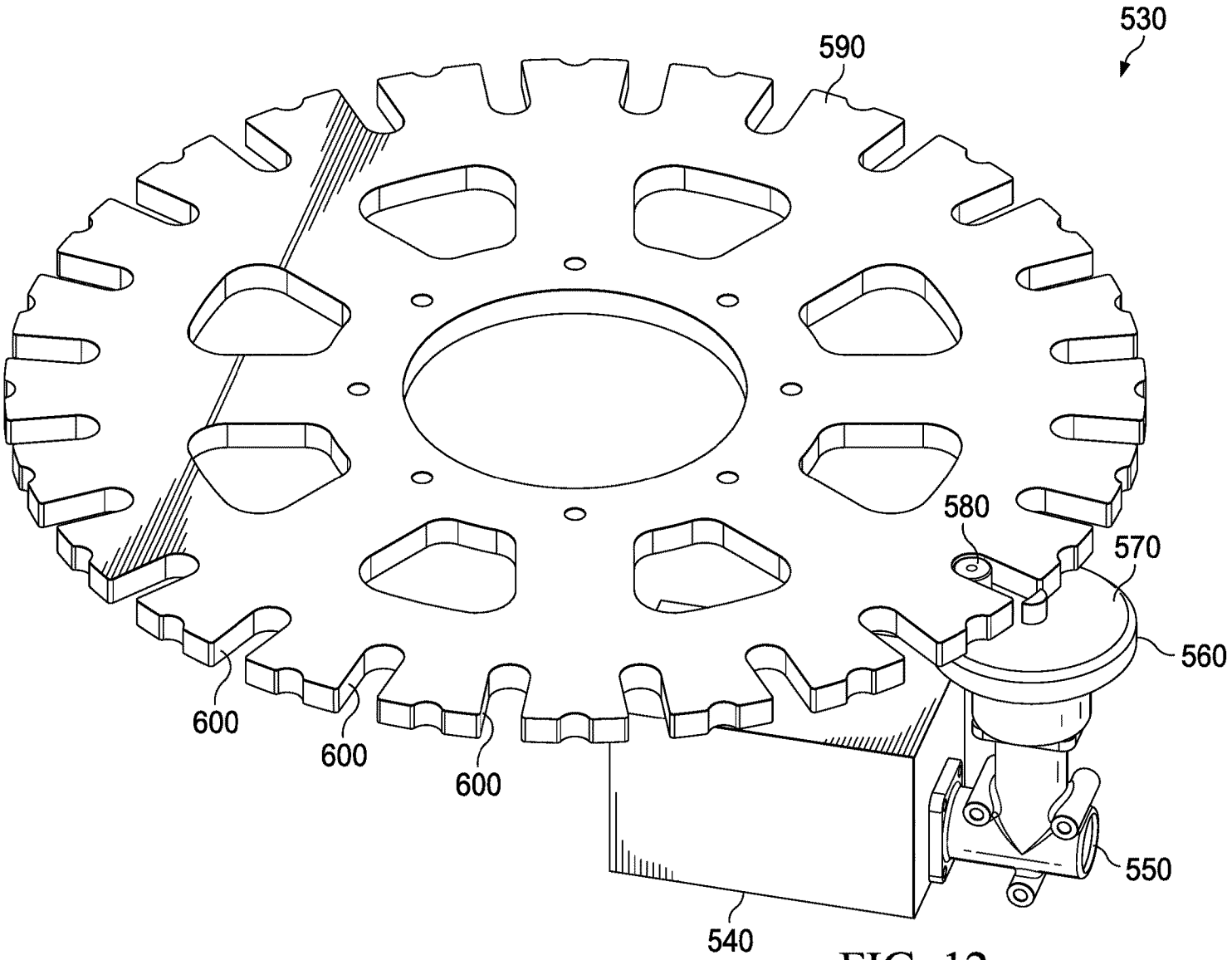
FIG. 12 depicts an embodiment of the UADD using a drive mechanism with a Geneva wheel.

FIG. 12 shows an example of a Geneva drive mechanism 530 that could be used as an alternative to the other drive mechanisms disclosed herein. Geneva drive mechanism 530 comprises a motor 540 and gear box 550 that combine to continuously turn a Geneva crank 560. Geneva crank 560 comprises a substantially planar wheel 570 and pin 580. Main wheel 590 comprises a plurality of slots 600 which are configured to mate with pin 580. As will be understood by those of skill in the art, the continuous rotation of Geneva crank 560 will result in intermittent rotation of main wheel 590 as pin 580 moves in and out of each slot 600.

Figure 13:
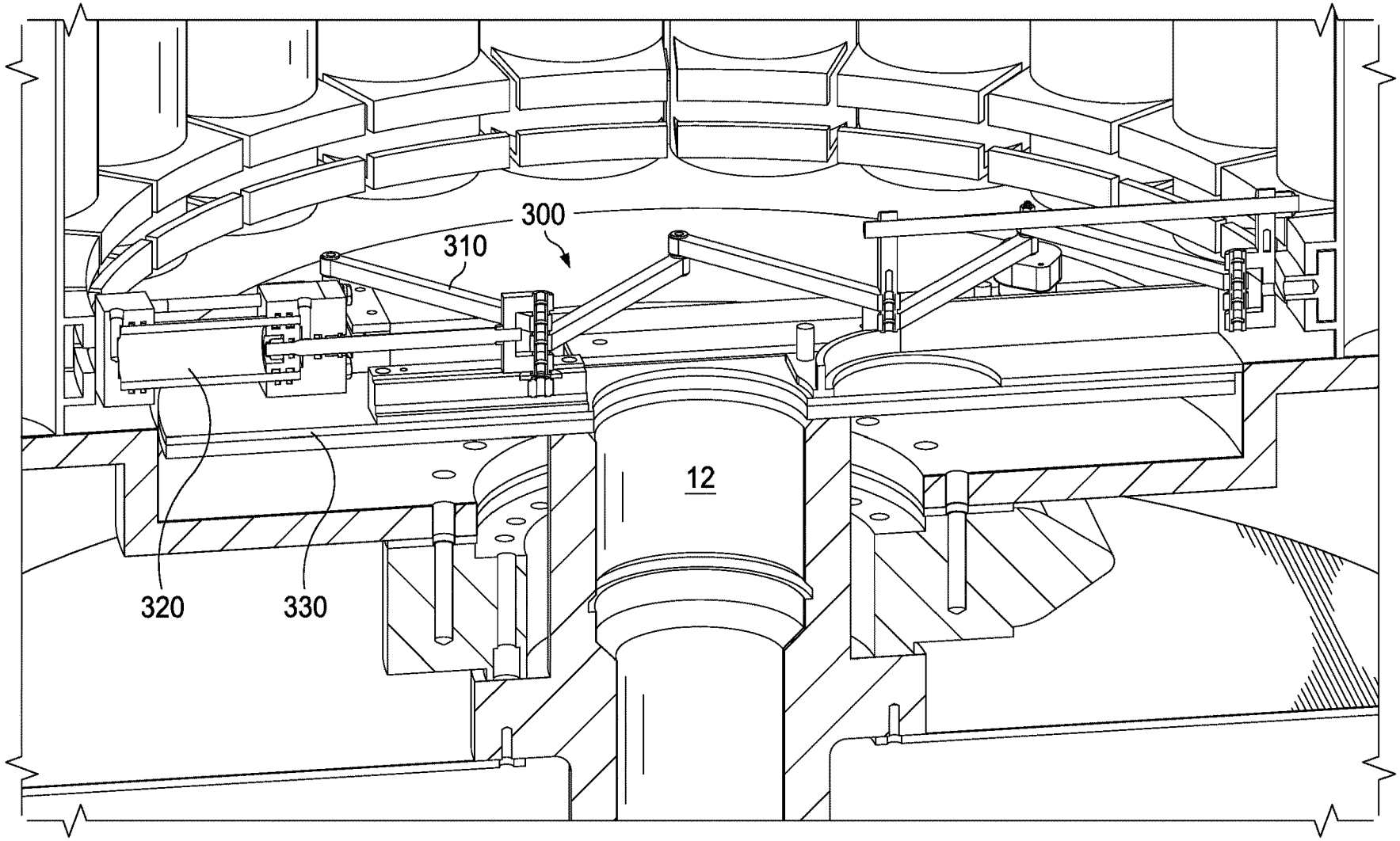
FIG. 13 depicts a close up of the internal cut out of the scissor arms of an embodiment of the UADD.

Referring to FIG. 13, this depicts a close up view of the scissor arm 300 and its extendable arm 310, hydraulic actuator 320, and scissor guide 330.

Figure 14:
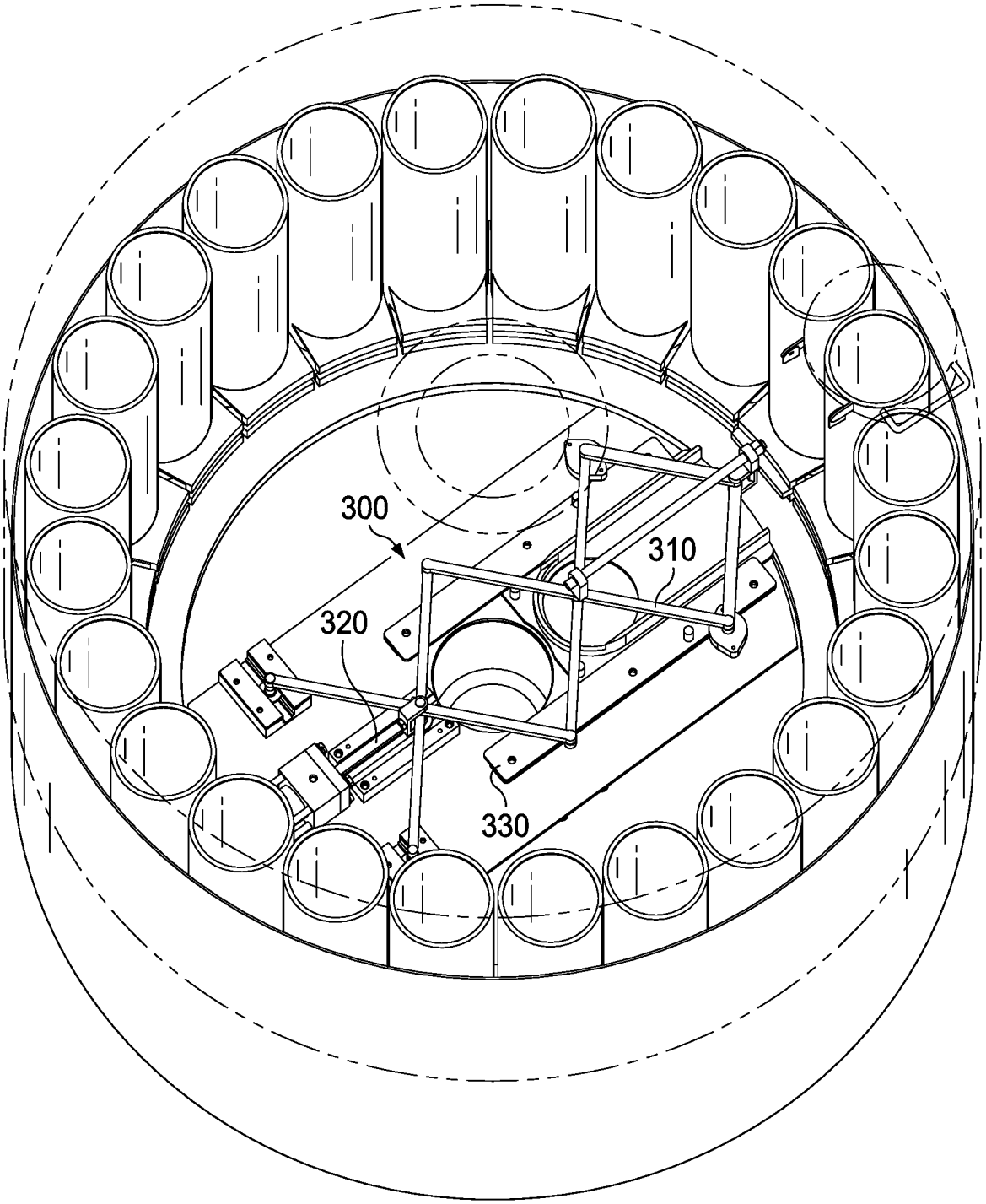
FIG. 14 depicts a top level view of the scissor arms of the UADD.

FIG. 14 depicts a view from above the scissor arm 300.

Figure 15:
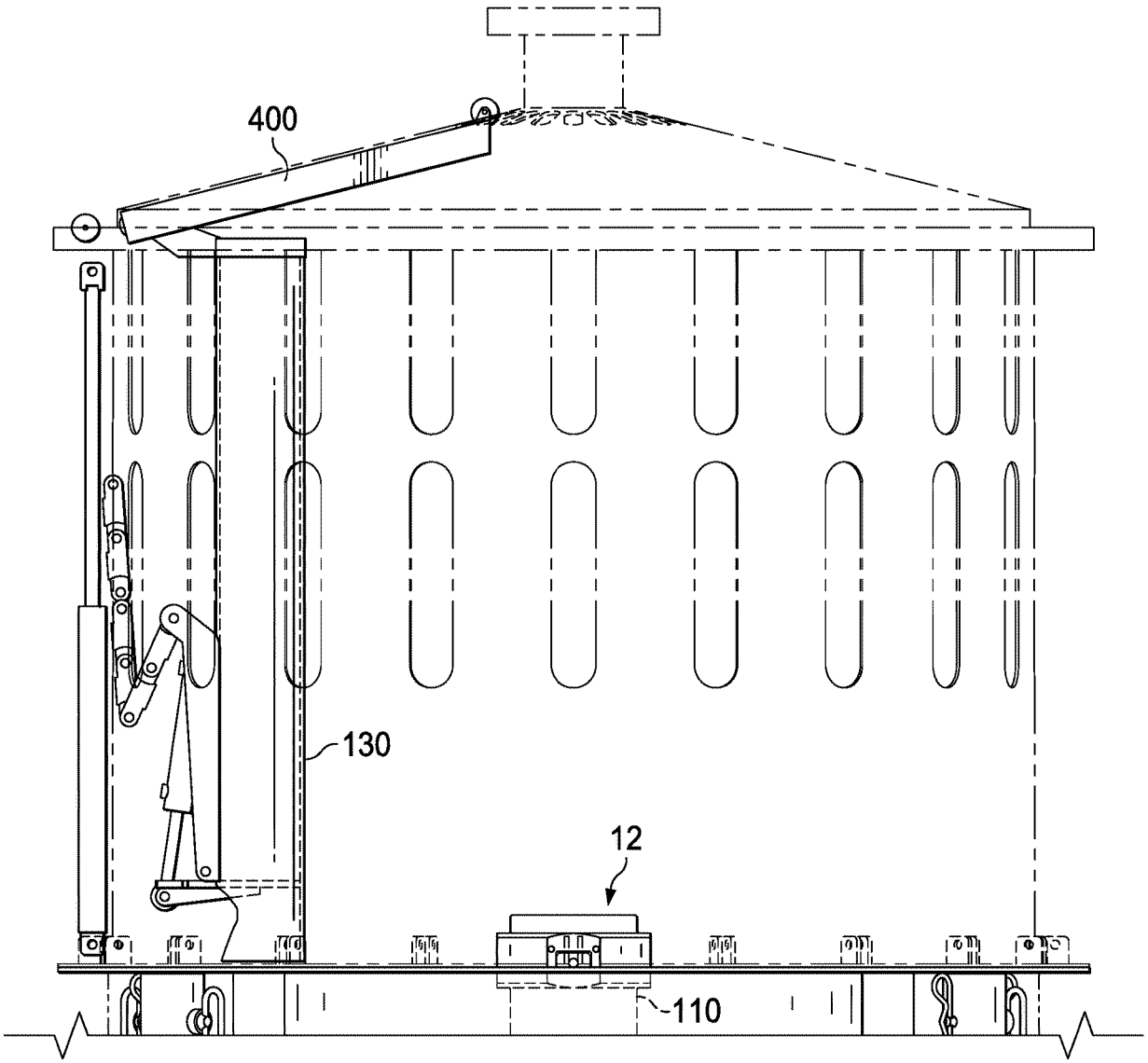
FIG. 15 depicts an exemplary embodiment of the UADD with carriers with stationary home positions and carrier-specific deployment devices comprised of a cylinder/pulley/track system.

Referring to FIG. 15, an internal view depicts an embodiment of the UADD interior. Like certain of the other embodiments discussed above, the UADD has a plurality of carriers 130 surrounding a centrally disposed tube 110 for deployment down the drop zone 12. However, unlike the other embodiments, the carriers 130 in this embodiment are not indexed but instead remain in the same angular position (i.e., on the same radial plane) with respect to drop zone 12. Rather than indexing carriers 130, the UADD includes a linear actuator associated with each carrier 130, which is configured to move the carrier from its position stored near the outer housing to a position over the drop zone 12 for deployment.

The linear actuators of this embodiment may take a variety of different forms. As shown in FIG. 15, the linear actuators may be implemented as a linear track deployment device 400 which moves the selected carrier 130 via a track, roller, and pulley system. In this particular configuration, a cable is connected at one end to a hydraulic cylinder, from where it passes over a pulley, a series of bearing guided rollers, and over another pulley before extending into the interior of the UADD, where it attaches to the carrier 130. When the hydraulic cylinder retracts, the pulley and roller system will cause the cable to lift carrier 130 radially inward and axially upward, such that it is aligned with the drop zone 12, as shown in FIG. 16.

Figure 16:
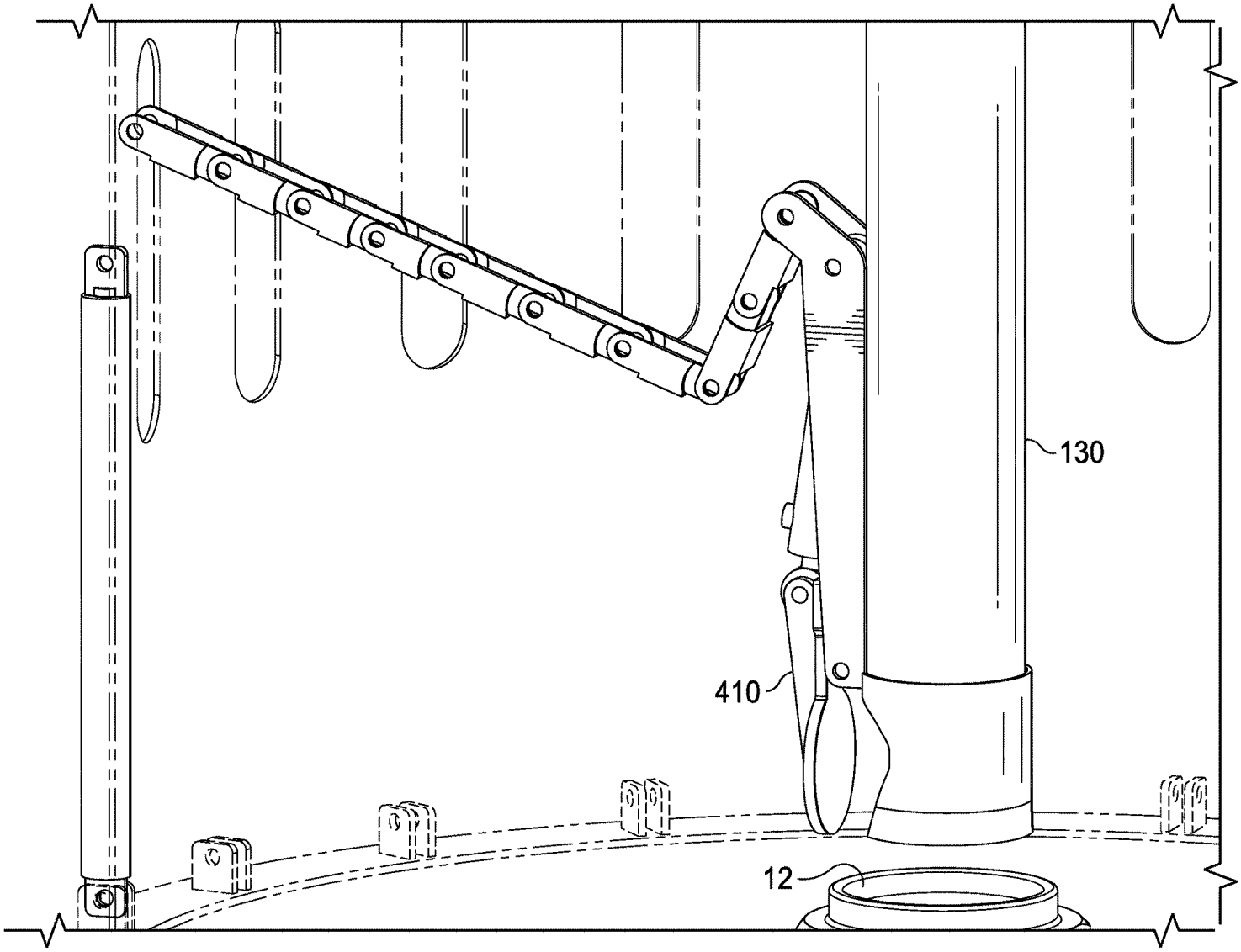
FIG. 16 depicts the embodiment of FIG. 9 after the tool or device within the carrier has been dropped into the drop zone.

Referring to FIG. 16, this depicts the UADD with a linear track deployment device 400 deploying a tool or device down the drop zone 12. This particular figure shows a swing style carrier gate 410 attached to the carrier 130, which controls the deployment of the tool or device. Carrier gate 410 may be controlled by the retraction of a hydraulic cylinder, as shown in FIG. 16.

In addition to the configuration shown in FIGS. 15 and 16, there are many other devices and arrangements that could be used as the linear actuators for this embodiment. For example, a hydraulic cylinder could be directly attached to each carrier 130, such that the retraction of the cylinder would cause the radial and axial translation necessary to move carrier 130 from its home position into alignment with drop zone 12. An electric drive system utilizing solenoids could also be used.

Figure 17:
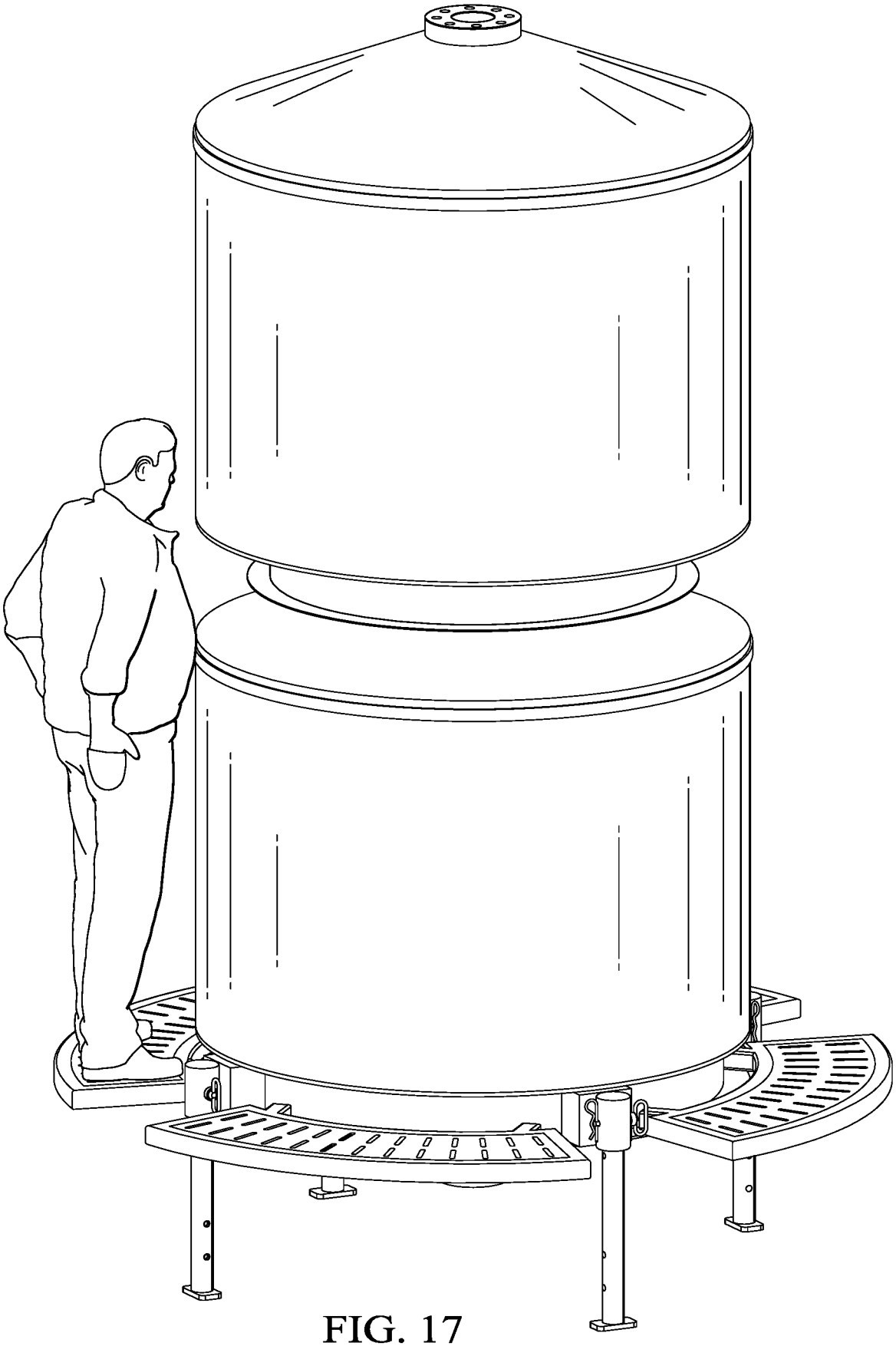
FIG. 17 depicts two UADDs installed one on top of another.

Referring to FIG. 17, this depicts an installation of two UADDs in series. One UADD can be installed above another to provide additional capacity for tools and devices.

What is claimed is:

1. A universal atmospheric deployment device comprising:

a substantially planar base comprising an upper surface and a lower surface;

a substantially cylindrical drop tube comprising:

a longitudinal axis;

an upper opening disposed above the upper surface of the base; and a lower opening disposed below the lower surface of the base;

a plurality of carriers radially offset from the longitudinal axis, each of the plurality of carriers comprising:

one or more sidewalls defining an interior of the carrier, said interior configured to receive one or more objects;

an upper opening; and a lower opening; and a deployment device configured to selectively translate each of the plurality of carriers in a radial direction, such that the lower opening of the carrier is substantially aligned with the upper opening of the drop tube.

2. The universal atmospheric deployment device of claim 1, wherein the one or more sidewalls of each of the plurality of carriers is substantially cylindrical.

3. The universal atmospheric deployment device of claim 1, wherein:

the base is configured to rotate about the first longitudinal axis, such that each of the plurality of carriers is indexed to a new position when the base is rotated; and the deployment device is configured to translate each of the plurality of carriers only when the base has been rotated so as to index the carrier to a predetermined position.

4. The universal atmospheric deployment device of claim 3, further comprising a slewing drive configured to rotate the base.

5. The universal atmospheric deployment device of claim 3, further comprising a Geneva drive configured to rotate the base.

6. The universal atmospheric deployment device of claim 3, further comprising a ratcheting linear drive mechanism configured to rotate the base.

7. The universal atmospheric deployment device of claim 3, further comprising a retaining track configured to prevent the plurality of carriers from being radially translated unless the carrier has been indexed to the predetermined position.

8. The universal atmospheric deployment device of claim 1, wherein the deployment device comprises a scissor arm.

9. The universal atmospheric deployment device of claim 1, wherein the deployment device comprises a hydraulic cylinder.

10. The universal atmospheric deployment device of claim 1, further comprising a removable cover disposed above the plurality of carriers.

11. The universal atmospheric deployment device of claim 1, further comprising a pressure tube comprising:

a lower opening configured to connect to the upper opening of the drop tube; and an upper opening disposed above the sidewalls of the plurality of carriers.

12. The universal atmospheric deployment device of claim 1, wherein each of the plurality of carriers further comprises a gate configured to selectively allow an object within the interior of the carrier to pass through the lower opening.

13. The universal atmospheric deployment device of claim 12, further comprising an actuator configured to selectively open the gate of each of the plurality of carriers when the lower opening of such carrier is substantially aligned with the upper opening of the drop tube.

14. The universal atmospheric deployment device of claim 13, wherein the actuator is located remotely from the plurality of carriers.

15. The universal atmospheric deployment device of claim 1, further comprising an outer housing comprising one or more sidewalls substantially orthogonal to the base.

16. A method of deploying objects into a wellbore, said method comprising:

connecting to the wellbore a lower end of a pressure-to-atmosphere control apparatus comprising an upstream isolation valve, a downstream isolation valve, and a chamber therebetween;

connecting to an upper end of the pressure-to-atmosphere control apparatus a universal atmospheric deployment device comprising:

a substantially planar base comprising an upper surface and a lower surface;

a substantially cylindrical drop tube comprising:

a longitudinal axis;

an upper opening disposed above the upper surface of the base; and a lower opening disposed below the lower surface of the base;

a plurality of carriers radially offset from the longitudinal axis, each of the plurality of carriers comprising:

one or more sidewalls defining an interior of the carrier, said interior configured to receive one or more objects;

an upper opening; and a lower opening; and radially translating a first carrier such that the lower opening of the carrier is substantially aligned with the upper opening of the drop tube;

passing one or more objects through the lower opening of the carrier and into the drop tube;

passing the object into the chamber;

closing the upstream isolation valve of the pressure-to-atmosphere control apparatus; and opening the downstream isolation valve of the pressure-to-atmosphere control apparatus, such that the object passes through said valve and into the wellbore.

17. The method of claim 16, further comprising the step of opening the upstream isolation valve of the pressure-to-atmosphere control apparatus, such that the object passes through the lower opening of said drop tube and into the chamber.

18. The method of claim 16, wherein:

the wellbore is at a first pressure;

when the step of passing the object into the chamber is performed, the chamber is at a second pressure which is lower than the first pressure; and the method further comprises the step of increasing the pressure within the chamber from the second pressure to a third pressure substantially equal to the first pressure, said step being performed after closing the upstream isolation valve and before opening the downstream isolation valve.

19. The method of claim 16, further comprising rotating the base of the universal atmospheric deployment device, such that each of the plurality of carriers is indexed to a new position.

20. The method of claim 19, wherein the step of radially translating the first carrier is performed only after said carrier has been indexed to a predetermined position.

21. The method of claim 16, wherein the universal atmospheric deployment device further comprises a removable cover and the method further comprises the steps of removing said cover and placing the object within the interior of the carrier.

22. The method of claim 16, wherein:

each of the plurality of carriers further comprises a gate proximate to the lower opening; and the step of passing one or more objects through the lower opening of the carrier and into the drop tube comprises opening the gate of the first carrier.

* * * * *